US007572761B2

(12) United States Patent
Gefvert

(10) Patent No.: US 7,572,761 B2
(45) Date of Patent: Aug. 11, 2009

(54) PROCESS FOR CLEANING AND SOFTENING FABRICS

(75) Inventor: David L. Gefvert, Chester, VA (US)

(73) Assignee: Evonik Degussa GmbH, Essen (DE)

( * ) Notice: Subject to any disclaimer, the term of this patent is extended or adjusted under 35 U.S.C. 154(b) by 477 days.

(21) Appl. No.: 11/272,202

(22) Filed: Nov. 14, 2005

(65) Prior Publication Data

US 2007/0111925 A1 May 17, 2007

(51) Int. Cl.
*C11D 1/825* (2006.01)
*C11D 1/83* (2006.01)

(52) U.S. Cl. ..... 510/499; 510/527

(58) Field of Classification Search ..... 510/499, 510/527

See application file for complete search history.

(56) References Cited

U.S. PATENT DOCUMENTS

| | | | |
|---|---|---|---|
| 5,622,925 | A | 4/1997 | Debuzzaccarini |
| 5,871,590 | A | 2/1999 | Hei |
| 5,981,466 | A | 11/1999 | Morelli |
| 6,191,099 | B1 | 2/2001 | Crutcher |
| 6,737,050 | B2 | 5/2004 | Doi |
| 2002/0159966 | A1 | 10/2002 | Doi |
| 2004/0142840 | A1 | 7/2004 | Debuzzaccarini |

FOREIGN PATENT DOCUMENTS

| | | | | |
|---|---|---|---|---|
| EP | 385562 | A2 | * | 9/1990 |
| FR | 2 760 021 | A1 | | 8/1998 |
| GB | 1 226 801 | | | 3/1971 |
| GB | 1226801 | | * | 3/1971 |
| GB | 1 601 359 | | | 10/1981 |
| WO | WO 90/03423 | | | 4/1990 |
| WO | WO 96/12004 | | | 4/1996 |
| WO | WO 97/12021 | | * | 4/1997 |
| WO | WO 00/52124 | | | 9/2000 |
| WO | WO 2004/056955 | A1 | | 7/2004 |

OTHER PUBLICATIONS

International Search Report for PCT/EP2006/067364 filed Oct. 13, 2006.
International Preliminary Report on Patentability for PCT/EP2006/067364 filed Oct. 13, 2006.
Written Opinion of the International Searching authority for PCT/EP2006/067364 filed Oct. 13, 2006.
English language abstract of WO 90/03423, listed above as document B4.

* cited by examiner

*Primary Examiner*—John R Hardee
(74) *Attorney, Agent, or Firm*—Law Office of: Michael A. Sanzo, LLC

(57) ABSTRACT

Laundry detergents comprising a fabric softening effective amount of an alkoxypropylamine of structures (I) or (II)

$$R^1—O—(CH_2)_3—NHR^2 \quad (I)$$

$$R^1—O—(CH_2)_3—NR^3{}_2(CH_3)^+X^- \quad (II)$$

wherein $R^1$ is a $C_{8-20}$ alkyl group, $R^2$ is hydrogen or $(CH_2)_3NH_2$, $R^3$ is $CH_3$ or $CH_2CH_2OH$ and $X^-$ is an anion, or of a salt of a compound of structure (I), provide simultaneous cleaning and softening of fabrics without the need for an additional fabric softener.

8 Claims, No Drawings

PROCESS FOR CLEANING AND SOFTENING FABRICS

FIELD OF THE INVENTION

The invention relates to a method for simultaneously cleaning and softening fabrics with a detergent, comprising a fabric softening effective amount of an alkoxypropylamine compound, to provide clean and softened fabrics without the additional use of a fabric softener. The invention also relates to laundry detergents useful for this method.

BACKGROUND OF THE INVENTION

Laundry that has been cleaned with a commercial laundry detergent and dried thereafter usually has a stiff appearance and feels hard to the touch. Fabric softeners are commonly used to provide laundry with a more comfortable soft touch. Such fabric softeners are applied after the wash, usually in the form of a rinse cycle fabric softener that is added to a rinse after the wash cycle. Such separate use of a laundry detergent and fabric softener is inconvenient and therefore numerous attempts have been made to provide a laundry detergent that has a fabric softening action.

The fabric softening actives of the quaternary ammonium salt type commonly used in fabric softeners cannot be used in laundry detergent formulations containing an anionic surfactant, because they form insoluble salts with the anionic surfactant. A range of alternative fabric softening actives have been suggested for incorporation into laundry detergents, but there is still a need for fabric softening actives and that can be formulated with a large a range of anionic surfactants and provide laundry detergents with improved softening action.

U.S. Pat. No. 5,622,925 discloses liquid laundry detergents with softening properties comprising an anionic surfactant and a quaternary ammonium fabric softening agent of a specified structure. Compounds of this type have found commercial use in laundry detergents with fabric softening action.

WO 90/03423 discloses the use of alkoxypropylamines with a $C_{8-22}$ alkoxy group as detergency enhancing additives for laundry detergents comprising anionic or nonionic surfactants. The document contains no disclosure of a fabric softening action of the described laundry detergents and does not suggest to use the disclosed laundry detergents for softening fabrics without the use of an additional fabric softener.

U.S. Pat. No. 5,981,466 and WO 97/12021 disclose the use of specific primary and/or tertiary amines, encompassing alkoxypropylamines with a $C_{4-18}$ alkoxy group, as suds suppressing additives for liquid laundry detergents comprising an alkyl alkoxy sulfate and/or alkyl sulfate surfactant. The documents contain no disclosure of a fabric softening action of the described laundry detergents and do not suggest to use the disclosed laundry detergents for softening fabrics without the use of an additional fabric softener.

WO 96/12004 discloses detergents, comprising a lipolytic enzyme and specific primary and/or tertiary amines, encompassing alkoxypropylamines with a $C_{6-12}$ alkoxy group, having enhanced detergency for grease and oil stains. The detergents may also contain anionic or nonionic surfactants. The document contains no disclosure of a fabric softening action of the described laundry detergents and does not suggest to use the disclosed laundry detergents for softening fabrics without the use of an additional fabric softener.

U.S. Pat. No. 5,871,590 discloses vehicle cleaning compositions containing fatty alkyl ether amines and a nonionic surfactant. The fatty alkyl ether amines encompass alkoxypropylamines and alkoxypropylaminopropylamines with $C_{6-28}$ alkoxy groups. The disclosure is not related to laundry detergents.

GB 1 601 359 discloses rinse cycle fabric softeners comprising a combination of a cationic surfactant and specific nonionic fabric lubricants. The disclosed cationic surfactants encompass salts of alkoxypropylamines and alkoxypropylaminopropylamines with $C_{8-22}$ alkoxy groups. The cationic surfactant acts as a carrier material to provide deposition of the nonionic onto fabrics. The document does not disclose that the cationic surfactants provide a softening action on their own.

U.S. Pat. No. 6,737,050 discloses hair cleansing compositions comprising anionic and/or nonionic surfactants and quaternary ammonium salts having one $C_{6-24}$ alkoxypropyl group and three alkyl or hydroxyalkyl groups as substituents. The disclosed hair cleansing compositions impart good flexibility and smoothness to human hair. The document does not disclose the use of such compositions for treating fabrics.

U.S. Pat. No. 6,191,099 discloses a method for cleaning hydrocarbon-containing soils from surfaces using a detergent comprising a quaternary ammonium compound and a nonionic surfactant. The quaternary ammonium compounds encompass compounds having one $C_{6-22}$ alkoxypropyl group, as well as three methyl groups or a methyl group and two hydroxyalkyl groups bonded to the same nitrogen atom. The document contains no disclosure of a fabric softening action of the described detergent and does not suggest to use the disclosed detergent for softening fabrics.

Applicants have now found that alkoxypropylamine compounds of structures (I) and (II) and the salts of compounds of structure (I) are surprisingly efficient in softening fabrics when used in a laundry detergent comprising an anionic and/or nonionic surfactant.

$$R^1—O—(CH_2)_3—NHR^2 \quad (I)$$

$$R^1—O—(CH_2)_3—NR^3{}_2(CH_3)^+X^- \quad (II)$$

$R^1$ is a $C_{8-20}$ alkyl group,
$R^2$ is hydrogen or $(CH_2)_3NH_2$,
$R^3$ is $CH_3$ or $CH_2CH_2OH$ and
$X^-$ is an anion The alkoxypropylamine compounds of the invention have not been described as fabric softening actives up to now and therefore their fabric softening properties were not predictable.

SUMMARY OF THE INVENTION

The present invention is directed to a process for simultaneously cleaning and softening fabrics, comprising a) treating a fabric with an aqueous solution or dispersion of a laundry detergent comprising
   from 10 to 95 wt. % of an anionic and/or nonionic surfactant and
   a fabric softening effective amount of an alkoxypropylamine compound selected from the group consisting of compounds of structure (I) and (II)

$$R^1—O—(CH_2)_3—NHR^2 \quad (I)$$

$$R^1—O—(CH_2)_3—NR^3{}_2(CH_3)^+X^- \quad (II)$$

wherein $R^1$ is a $C_{8-20}$ alkyl group, $R^2$ is hydrogen or $(CH_2)_3NH_2$, $R^3$ is $CH_3$ or $CH_2CH_2OH$ and $X^-$ is an anion, or a salt of a compound of structure (I), b) rinsing said fabric one or more times with water or an aqueous composition not containing a fabric softener, and c) drying said fabric.

The laundry detergent of the invention, having a fabric softening action, comprises a) from 10 to 95 wt. % of an anionic and/or nonionic surfactant and b) a fabric softening effective amount of an alkoxypropylamine compound selected from the group consisting of compounds of structure (I) and (II)

$$R^1—O—(CH_2)_3—NHR^2 \quad (I)$$

$$R^1—O—(CH_2)_3—NR^3{}_2(CH_3)^+X^- \quad (II)$$

wherein $R^1$ is a $C_{8-20}$ alkyl group, $R^2$ is hydrogen or $(CH_2)_3NH_2$, $R^3$ is $CH_3$ or $CH_2CH_2OH$ and $X^-$ is an anion, or a salt of a compound of structure (I)

DETAILED DESCRIPTION OF THE INVENTION

The process of the present invention for simultaneously cleaning and softening fabrics comprises a first step of treating a fabric with an aqueous solution or dispersion of a laundry detergent according to the invention. This treatment can be carried out as a hand wash or preferably with a commercial washing machine for a time commonly used for washing laundry. The temperature in this step is not critical and can be anywhere from ambient temperature to 95° C.

The first step of treating with the laundry detergent of the invention is followed by one or more rinsing steps, where the fabric is rinsed with water or an aqueous composition which does not contain a fabric softener. The rinsing step is conveniently performed in the same washing machine as the first step and the wash liquid and rinse liquid(s) are preferably removed from the fabric by spin-drying.

In a final step, the rinsed fabric is dried. Drying may be achieved by any conventional means, such as hanging the fabric on a line or drying in a tumbler.

The process of the invention provides cleaned fabrics with a soft touch without the need for using an additional fabric softener. In addition, fabrics cleaned with the process of the invention show less static charging when they are dried in a tumbler.

The laundry detergent according to the invention, used in the process of the invention, comprises from 10 to 95 wt. % of an anionic and/or nonionic surfactant and a specific alkoxypropylamine compound in a fabric softening effective amount.

In one embodiment of the invention, the alkoxypropylamine compound used in the process of the invention is a compound of structure (I) or a salt of such compound, where $R^1$ is a $C_{8-20}$ alkyl group and $R^2$ is hydrogen or $(CH_2)_3NH_2$.

$$R^1—O—(CH_2)_3—NHR^2 \quad (I)$$

$R^1$ may be a linear or branched alkyl group. Preferably, $R^1$ is a $C_{10-13}$ alkyl group and more preferably $R^1$ is lauryl, n-tridecyl or isotridecyl.

Compounds of structure (I) with $R^2$=H can be prepared by reacting an alcohol $R^1OH$ with acrylonitrile in a Michael addition reaction and hydrogenating the addition product. Compounds of structure (I) with $R^2=(CH_2)_3NH_2$ can be prepared by reacting a compound of structure (I) with $R^2$=H with acrylonitrile in a Michael addition reaction and hydrogenating the addition product. Compounds of structure (I) are commercially available from Goldschmidt Chemical under the trade names Adogen 182 ($R^1$=lauryl, $R^2$=H), Adogen 183 ($R^1$=isotridecyl, $R^2$=H), Adogen 582 ($R^1$=lauryl, $R^2=(CH_2)_3NH_2$) and Adogen 583 ($R^1$=isotridecyl, $R^2=(CH_2)_3NH_2$)

In another embodiment of the invention, the alkoxypropylamine compound used in the process of the invention is a compound of structure (II), where $R^1$ is a $C_{8-20}$ alkyl group, $R^3$ is $CH_3$ or $CH_2CH_2OH$ and $X^-$ is an anion.

$$R^1—O—(CH_2)_3—NR^3{}_2(CH_3)^+X^- \quad (II)$$

Preferably, $R^1$ is a $C_{10-13}$ alkyl group and more preferably $R^1$ is lauryl, n-tridecyl or isotridecyl. $X^-$ may be any anion and preferably is a monovalent anion. Most preferably $X^-$ is $Cl^-$ or $CH_3OSO_3^-$.

Compounds of structure (II) with $R^3=CH_3$ can be prepared by reacting a compound of structure (I) with $R^2$=H with a methylating agent, such as methyl chloride or dimethyl sulfate. Compounds of structure (II) with $R^3=CH_2CH_2OH$ can be prepared by reacting a compound of structure (I) with $R^2$=H with 2 equivalents of ethylene oxide followed by reaction with a methylating agent.

The minimum fabric softening effective amount of the alkoxypropylamine compound depends on the structure of the alkoxypropylamine compound and the amount and nature of the other components used in the laundry detergent of the invention and can be determined by a skilled person by routine experimentation. Preferably, the laundry detergent comprises from 3 to 10 wt. % of the alkoxypropylamine compound.

The laundry detergent of the invention, used in the process of the invention, further comprises from 10 to 95 wt. % of an anionic surfactant, a nonionic surfactant or both an anionic surfactant and a nonionic surfactant.

Suitable anionic surfactants are for example surfactants with sulfonate groups, preferably alkylbenzenesulfonates, alkanesulfonates, alpha-olefinsulfonates, alpha-sulfofatty acid esters or sulfosuccinates. Preferred alkylbenzenesulfonates comprise a linear or branched chain alkyl group with 8 to 20 carbon atoms, in particular 10 to 16 carbon atoms. Preferred alkanesulfonates comprise a linear chain alkyl group with 12 to 18 carbon atoms. Preferred alpha-olefinsulfonates are the products of sulfonating alpha-olefins having 12 to 18 carbon atoms. Preferred alpha-sulfofatty acid esters are the products of sulfonating fatty acid esters of fatty acids having 12 to 18 carbon atoms and short chain alcohols selected from methanol, ethanol, 1-propanol and 2-propanol.

A further class of suitable anionic surfactants are surfactants comprising sulfate groups, preferably alkylsulfates and ethersulfates. Preferred alkylsulfates comprise linear chain alkyl group with 12 to 18 carbon atoms. Suitable are also beta-branched alkylsulfates and alkylsulfates comprising one or more branchings at the center of the alkyl group. Preferred ethersulfates are the products of ethoxylating linear chain alcohols having 12 to 18 carbon atoms with 2 to 6 ethylene oxide units and subsequent sulfatation.

Another class of suitable anionic surfactants are soaps, such as for example alkali metal salts of lauric acid, myristic acid, palmitic acid, stearic acid or mixtures thereof and example alkali metal salts of natural fatty acid mixtures, such as for example coconut fatty acid, palm kernel fatty acid or tallow fatty acid.

Suitable non-ionic surfactants are for example alkoxylated compounds, in particular ethoxylated and propoxylated compounds. Preferred are condensation products of alkylphenols or fatty alcohols with 1 to 50 equivalents ethylene oxide, propylene oxide or mixtures thereof and in particular condensation products with 1 to 10 equivalents. Another class of suitable non-ionic surfactants are polyhydroxyfatty acid amides with the amide nitrogen substituted by an organic residue carrying one or more hydroxyl groups which may additionally be alkoxylated. A further class of suitable nonionic surfactants are alkyl glycosides comprising a linear or branched chain alkyl group with 8 to 22 carbon atoms, in particular 12 to 18 carbon atoms, and a mono- or diglycoside unit which is preferably derived from glucose.

The laundry detergent of the invention may be a solid composition. Such solid compositions may have the appearance of powders, granulates or molded bodies. The molded bodies may have the shape of extrudates, pellets, briquettes or tablets. Such molded bodies may be prepared by processes of press agglomeration, such as for example extrusion, briquetting or tabletting. Laundry detergent composition in the form of press molded bodies may contain additional binders to improve the hardness of the molded bodies. However, laundry detergent composition in the form of press molded bodies are preferably made without the use of additional binders with one of the wash active components, preferably a nonionic surfactant, acting as the binder. The solid laundry detergent compositions of the invention preferably comprise from 10 to 30 wt. % of anionic and/or nonionic surfactants and from 5 to 10 wt. % of the alkoxypropylamine compound.

In a further embodiment, the laundry detergent of the invention may be a liquid or gel composition with the alkoxypropylamine compound dissolved or dispersed in the liquid or gel phase. Solid components of the detergent may be dispersed in the liquid or gel phase. The rheologic properties of the liquid or gel composition are preferably selected to maintain any solid components dispersed in the liquid or gel phase during storage with no settling of solids. In this case the liquid or gel composition preferably shows thixotropic or pseudoplastic flow. Such flow properties may be achieved by additives, such as dispersable clays, in particular montmorillonites; precipitated or pyrogenic silicas; vegetable gums, in particular xanthanes; and synthetic polymeric thickeners, such as vinyl polymers comprising carboxyl groups. The laundry detergent compositions of the invention in liquid or gel form preferably comprise from 3 to 6 wt. % of the alkoxypropylamine compound.

The laundry detergent of the present invention may comprise further components, such as for example builders, alkaline components, bleaching agents, bleach activators, enzymes, chelating agents, graying inhibitors, foam inhibitors, brighteners, colorants or perfumes.

Suitable as builders are all compounds or compositions that are capable of sequestering calcium or magnesium ions from an aqueous solution. Preferred builders are alkali metal phosphates and alkali metal polyphosphates, in particular pentasodium triphosphate; water soluble or water insoluble sodium silicates, in particular layered silicates of the formula $Na_5Si_2O_5$; zeolites of the structure type A, X and P and mixtures thereof; and trisodium citrate. Organic co-builders may be used in addition to builders, such as for example polyacrylic acid, polyaspartic acid and copolymers of acrylic acid with methacrylic acid, acrolein or sulfonated vinyl monomers and alkali metal salts thereof as well as mixtures thereof.

Suitable alkaline components for laundry detergents of the present invention provide a pH value in the range of 8 to 12 in the aqueous wash liquid at the use concentration of the laundry detergent. Preferred alkaline components are sodium carbonate, sodium sesquicarbonate and sodium metasilicate. Suitable are also other soluble alkali metal silicates.

Suitable bleaching agents for laundry detergents of the present invention are peroxygen compounds, such as alkali metal perborates, alkali metal carbonate perhydrates, alkali metal persilicates, alkali metal persulfates, alkali metal peroxophosphates, alkali metal peroxopyrophosphates, diacyl peroxides, aromatic peroxy acids and aliphatic peroxy acids. Preferred bleaching agents are sodium perborate tetrahydrate, sodium perborate monohydrate, sodium carbonate perhydrate, peroxylauric acid, peroxystearic acid, epsilon-phthalimidoperoxycarboxylic acids, 1,12-diperoxydodecanedioic acid, 1,9-diperoxyazelaic acid and 2-decyldiperoxybutane-1,4-dioic acid. Most preferred are sodium perborate tetrahydrate, sodium perborate monohydrate and coated sodium carbonate perhydrate. Coated sodium carbonate perhydrate suitable for use in liquid detergent compositions is known from WO 2004/056955, which is hereby incorporated by reference.

Suitable bleaching activators for laundry detergents of the present invention are compounds with acyl groups bonded to nitrogen or oxygen atoms, which can undergo a perhydrolysis reaction with hydrogen peroxide in aqueous solution to give a peroxycarboxylic acid. Preferred compounds of this type are peracylated alkylenediamines, in particular tetraacetylethylenediamine (TAED); acylated triazinones, in particular 1,5-diacetyl-2,4-dioxohexahydro-1,3,5-triazine (DADHT); acylated glycolurils, in particular tetraacetylglycoluril (TAGU); N-acylimides, in particular N-nonanoylsuccinimide (NOSI); acylated phenolsulfonates, in particular n-nonanoyloxybenzenesulfonate and iso-nonanoyloxybenzenesulfonate salts (n-NOBS and iso-NOBS); carboxylic acid anhydrides such as phthalic acid anhydride; acylated polyhydric alcohols, such as ethyleneglycol diacetate, 2,5-diacetoxy-2,5-dihydrofuran, acetylated sorbitol and mannitol and acylated sugars, such as pentaacetylglucose; N-acylated lactams, in particular N-acetylcaprolactam, N-acetylvalerolactam, N-nonanoylcaprolactam and N-nonanoylvalerolactam.

A further class of suitable bleaching activators are the nitrites comprising amine or quaternary ammonium groups known from Tenside Surf. Det. 1997, 34(6), pages 404-409, which are hereby incorporated by reference.

Another class of suitable bleaching activators are transition metal complexes capable of activating hydrogen peroxide for stain bleaching. Suitable transition metal complexes are known from EP-A 0 544 490 page 2, line 4 to page 3, line 57; WO 00/52124 page 5, line 9 to page 8, line 7 and page 8, line 19 to page 11, line 14; WO 04/039932, page 2, line 25 to page 10, line 21; WO 00/12808 page 6, line 29 to page 33, line 29; WO 00/60043 page 6, line 9 to page 17, line 22; WO 00/27975, page 2, line 1 to 18 and page 3, line 7 to page 4, line 6; WO 01/05925, page 1, line 28 to page 3, line 14; WO 99/64156, page 2, line 25 to page 9, line 18; and GB-A 2 309 976, page 3, line 1 to page 8, line 32, which are hereby incorporated by reference.

The laundry detergents of the present invention may further comprise enzymes that enhance the cleaning action, preferably lipases, cutinases, amylases, neutral and alkaline proteases, esterases, cellulases, pectinases, lactases and peroxidases and mixtures thereof. The enzymes may be coated or may be adsorbed to one or more carrier components to protect them against loss of enzyme activity.

The laundry detergents of the present invention may also comprise chelating agents which are capable of sequestering transition metal ions and can inhibit the decomposition of peroxygen compounds in the detergent compositions and in the wash liquid during use of the detergent composition. Preferred chelating agents are phosphonic acids, in particular hydroxyethane-1,1-disphosphonate, nitrilotrimethylenephosphonate, diethylenetriamine-penta(methylenephosphonate), ethlyenediamine-tetra(methylenephosphonate) and hexamethylenediamine-tetra(methylenephosphonate); nitrilotriacetic acid; polyaminocarboxylic acids, in particular ethylenediaminetetraacetic acid, diethylenetriaminepentaacetic acid, ethylenediamine-N,N'-disuccinic acid, methylglycindiacetic acid and polyaspartic acid; polyvalent carboxylic acids and hydroxycarboxylic acids, in particular tartaric acid and citric acid; and the alkali metal and ammonium salts of said preferred chelating agents.

The laundry detergents of the present invention may further comprise graying inhibitors which keep soil particles suspended in the wash liquid and inhibit the redeposition of soil onto fibers. Suitable graying inhibitors are for example cellulose ethers, preferably carboxymethylcellulose and alkali metal salts thereof, methylcellulose, hydroxyethylcellulose, hydroxypropylcellulose and polyvinylpyrrolidone.

The laundry detergents of the present invention may also comprise foam inhibitors which reduce foam formation from the wash liquid during use. Suitable foam inhibitors are for example organopolysiloxanes, preferably polydimethylsiloxane, paraffins, waxes, as well as mixtures thereof with small particle silicas. Such foam inhibitors are well known from the prior art.

The laundry detergents of the present invention may also comprise brighteners which can compensate the yellowing of fibers by adsorbing to the fiber, absorbing UV light and reemitting blue light by fluorescence. Suitable brighteners are for example derivatives of diaminostilbenedisulfonic acid, such as 4,4'-bis-(2-anilino-4-morpholino-1,3,5-triazinyl-6-amino)-stilbene-2,2'-disulfonic acid and alkali metal salts thereof or substituted diphenylstyryls, such as 4,4'-bis-(2-sulfostyrlyl)-diphenyl and alkali metal salts thereof.

The laundry detergents of the present invention may further comprise colorants and/or perfumes to provide the compositions with a more pleasing appearance.

Laundry detergents of the present invention in the form of liquids or gels may further comprise up to 30 wt.-% of an organic solvent, preferably methanol, ethanol, n-propanol, iso-propanol, n-butanol, ethylene glycol, 1,2-propylene glycol, 1,3-propylene glycol, 1,4-butylene glycol, glycerin, diethylene glycol, ethylene glycol methyl ether, ethanolamine, diethanolamine or triethanolamine or mixtures thereof.

The following examples are provided to illustrate the present invention without intending to limit the scope of the invention.

EXAMPLES

Application testing of fabric softening detergent compositions.

Application testing was performed in sets of 4 detergents ranking the results within a set against each other. For each detergent in the set, four cotton towels and two twin size sheets of a 50% cotton-50% polyester fabric with a total weight of 1500 g to 1600 g were washed in a standard Kenmore laundry washer with a warm wash and cold rinse setting using 90 g of liquid detergent or 45 g of powder detergent. The washed fabrics were dried for 1 h in a standard Kenmore laundry drier. The dried cotton towels were stored at room temperature and assessed for tactile softness after 12 h storage. Four sets of towels were formed comprising one towel for each detergent tested and tactile softness was determined in a sensory evaluation by a panel of 8 panelists ranking the softness within each set. The scores were evaluated statistically by a Friedman Simple Ranking Test to determine at 95% confidence level if a difference in softening effect exists between two detergents. The detergents are listed in the examples in the order of their ranking with the detergent having the best softening effect in first place. Statistical differences are denoted by capital letters, the same letters denoting a difference below 95% confidence level and different letters denoting a difference above 95% confidence level. A ranking of A, AB and B denotes differences below 95% confidence level between the first and second and the second and third rank sample, but a difference above 95% confidence level between the first and third rank sample.

The following alkoxypropylamine compounds were used in the examples according to the invention:

| | |
|---|---|
| Adogen 91 | 3-($C_{9-11}$-alkoxy)propylamine |
| Adogen 180 | 3-(Isodecyloxy)propylamine |
| Adogen 182 | 3-(Lauryloxy)propylamine |
| Adogen 580 | 3-(3-(Isodecyloxy)propylamino)-propylamine |
| Adogen 582 | 3-(3-(Lauryloxy)propylamino)-propylamine |
| Adogen 91 diamine | 3-(3-($C_{9-11}$-alkoxy)propylamino)-propylamine |
| Adogen 180 ethoxy quat | 3-(Isodecyloxy)propyl di-(2-hydroxyethyl) methyl ammonium chloride |
| Adogen 183 ethoxy quat | 3-(Isotridecyloxy)propyl di-(2-hydroxyethyl) methyl ammonium chloride |

The following softening actives were used as comparative examples:

| | |
|---|---|
| TMLAC | Lauryl trimethyl ammonium chloride |
| Varisoft CPEM | Methyl cocoammonium pentaethoxylate methylsulfate |

The following detergents were used in the examples with the amounts of alkoxypropylamine compound or comparative softening active added as indicated in the examples:

Liquid base detergents of table 1, formulated with 18 wt. % total surfactant actives in water and adjusted to pH 10 by the addition of sodium hydroxide.

Commercial liquid laundry detergents:

All®, marketed by Unilever

Purex®, marketed by Dial

Tide® liquid, marketed by Procter & Gamble

Tide with a Touch of Downy®, marketed by Procter & Gamble

Wisk®, marketed by Unilever

Standard reference powder detergent:

AATCC 1993, marketed by the American Association of Textile Chemists and Colorists Commercial powder laundry detergent:

Tide free®, marketed by Procter & Gamble

TABLE 1

| Liquid base detergent | LAS [wt. %] | SLES [wt. %] | AEO [wt. %] |
|---|---|---|---|
| I | 25 | 25 | 50 |
| II | 30 | 0 | 70 |
| III | 50 | 50 | 0 |
| IV | 0 | 0 | 100 |

LAS = sodium n-dodecylbenzenesulfonate
SLES = sodium lauryl ether (3 EO) sulfate
AEO = $C_{12-15}$ alcohol ethoxylate (7 EO)

Examples 1 to 4

| Example | Detergent | Statistical rank |
|---|---|---|
| 1* | Base detergent I + 3.7 wt. % TMLAC | A |
| 2 | Base detergent I + 3.0 wt. % Adogen 91 | AB |
| 3* | Tide with a Touch of Downy | B |
| 4* | Base detergent I | C |

*Comparative example not according to the invention

Examples 5 to 8

| Example | Detergent | Statistical rank |
|---|---|---|
| 5 | Base detergent II + 3.0 wt. % Adogen 91 | A |
| 6* | Tide with a Touch of Downy | A |
| 7* | Base detergent II + 3.7 wt. % TMLAC | B |
| 8* | Base detergent II | B |

*Comparative example not according to the invention

Examples 9 to 12

| Example | Detergent | Statistical rank |
|---|---|---|
| 9 | Base detergent III + 5.0 wt. % Adogen 91 | A |
| 10* | Base detergent III + 3.7 wt. % TMLAC | A |
| 11 | Base detergent III + 5.0 wt. % Adogen 582 | A |
| 12* | Base detergent III | B |

*Comparative example not according to the invention

Examples 13 to 16

| Example | Detergent | Statistical rank |
|---|---|---|
| 13 | Base detergent IV + 5 wt. % Adogen 91 | A |
| 14* | Base detergent IV | B |
| 15* | Base detergent IV + 5 wt. % Varisoft CPEM | BC |
| 16* | Base detergent IV + 3.7 wt. % TMLAC | C |

*Comparative example not according to the invention

Examples 1 to 16 demonstrate that alkoxypropylamine compounds of the invention cause a significant softening effect in detergent compositions comprising anionic surfactants, nonionic surfactants or both types of surfactants.

Examples 17 to 20

| Example | Detergent | Statistical rank |
|---|---|---|
| 17* | Tide with a Touch of Downy | A |
| 18 | All + 5 wt. % Adogen 180 | B |
| 19 | All + 5 wt. % Adogen 180 ethoxy quat | C |
| 20* | All | C |

*Comparative example not according to the invention

Examples 21 to 24

| Example | Detergent | Statistical rank |
|---|---|---|
| 21* | Tide with a Touch of Downy | A |
| 22 | All + 5 wt. % Adogen 182 | A |
| 23 | All + 5 wt. % Adogen 582 | A |
| 24* | All | B |

*Comparative example not according to the invention

Examples 25 to 28

| Example | Detergent | Statistical rank |
|---|---|---|
| 25 | All + 4 wt. % Adogen 182 | A |
| 26 | All + 5 wt. % Adogen 180 ethoxy quat | A |
| 27* | Tide with a Touch of Downy | A |
| 28* | All | A |

*Comparative example not according to the invention

Examples 29 to 32

| Example | Detergent | Statistical rank |
|---|---|---|
| 29 | All + 5 wt. % Adogen 183 ethoxy quat | A |
| 30 | All + 5 wt. % Adogen 182 | A |
| 31* | Tide with a Touch of Downy | AB |
| 32* | All | B |

*Comparative example not according to the invention

Examples 33 to 36

| Example | Detergent | Statistical rank |
|---|---|---|
| 33 | Purex + 5 wt. % Adogen 91 | A |
| 34 | Purex + 5 wt. % Adogen 91 diamine | A |
| 35* | Purex + 10 wt. % TMLAC | B |
| 36* | Purex | C |

*Comparative example not according to the invention

Examples 37 to 40

| Example | Detergent | Statistical rank |
|---|---|---|
| 37 | Purex + 3 wt. % Adogen 580 | A |
| 38 | Purex + 3 wt. % Adogen 180 | B |
| 39* | Purex + 3 wt. % TMLAC | B |
| 40* | Purex | B |

*Comparative example not according to the invention

Examples 41 to 44

| Example | Detergent | Statistical rank |
|---|---|---|
| 41 | Purex + 5 wt. % Adogen 580 | A |
| 42 | Purex + 5 wt. % Adogen 91 | AB |
| 43 | Purex + 5 wt. % Adogen 180 | BC |
| 44* | Purex | C |

*Comparative example not according to the invention

Examples 45 to 48

| Example | Detergent | Statistical rank |
|---|---|---|
| 45 | Tide liquid + 5 wt. % Adogen 182 | A |
| 46* | Tide with a Touch of Downy | B |
| 47 | Tide liquid + 5 wt. % Adogen 183 ethoxy quat | BC |
| 48* | Tide liquid | C |

*Comparative example not according to the invention

Examples 49 to 52

| Example | Detergent | Statistical rank |
|---|---|---|
| 49 | Wisk + 5 wt. % Adogen 183 ethoxy quat | A |
| 50* | Tide with a Touch of Downy | A |
| 51 | Wisk + 5 wt. % Adogen 182 | A |
| 52* | Wisk | B |

*Comparative example not according to the invention

Examples 17 to 52 demonstrate that alkoxypropylamine compounds of the invention cause a significant softening effect when added to commercial liquid detergent compositions. The alkoxypropylamine compounds are therefore compatible with the components generally used in liquid detergents.

Examples 53 to 56

| Example | Detergent | Statistical rank |
|---|---|---|
| 53 | Tide free + 10 wt. % Adogen 182 | A |
| 54 | AATCC 1993 + 10 wt. % Adogen 182 | A |

-continued

| Example | Detergent | Statistical rank |
|---|---|---|
| 55* | AATCC 1993 | B |
| 56* | Tide free | C |

*Comparative example not according to the invention

Examples 57 to 60

| Example | Detergent | Statistical rank |
|---|---|---|
| 57 | AATCC 1993 + 10 wt. % Adogen 182 | A |
| 58 | Tide free + 10 wt. % Adogen 182 | B |
| 59* | Tide free | C |
| 60* | AATCC 1993 | C |

*Comparative example not according to the invention

Examples 53 to 60 demonstrate that alkoxypropylamine compounds of the invention cause a significant softening effect when added to powder detergent compositions.

What is claimed is:

1. A process for simultaneously cleaning and softening fabrics, comprising:

a) treating a fabric with an aqueous solution or dispersion of a laundry detergent comprising from 10 to 95 wt. % of an anionic and/or nonionic surfactant and a fabric softening effective amount of an alkoxypropylamine compound of structure (I): $R^1$—O—$(CH_2)_3$—$NHR^2$ (I), wherein $R^1$ is a $C_{8-20}$ alkyl group, and $R^2$ is $(CH_2)_3NH_2$; or of a salt of said alkoxypropylamine compound of structure (I);

b) rinsing said fabric one or more times with water or an aqueous composition not containing a fabric softener, and c) drying said fabric.

2. The process of claim 1, wherein $R^1$ is lauryl.

3. The process of claim 1, wherein $R^1$ is tridecyl.

4. The process of claim 1, wherein $R^1$ is isotridecyl.

5. The process of claim 1, wherein said laundry detergent comprises from 3 to 10 wt. % of said alkoxypropylamine compound.

6. The process of claim 5, wherein $R^1$ is lauryl.

7. The process of claim 5, wherein $R^1$ is tridecyl.

8. The process of claim 5, wherein $R^1$ is isotridecyl.

* * * * *

UNITED STATES PATENT AND TRADEMARK OFFICE

CERTIFICATE OF CORRECTION

PATENT NO. : 7,572,761 B2
APPLICATION NO. : 11/272202
DATED : August 11, 2009
INVENTOR(S) : David L. Gefvert It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 747 days.

Signed and Sealed this

Seventh Day of September, 2010

David J. Kappos

David J. Kappos
*Director of the United States Patent and Trademark Office*